US007159598B2

(12) United States Patent
Gregory

(10) Patent No.: US 7,159,598 B2
(45) Date of Patent: Jan. 9, 2007

(54) CLEANING SYSTEM AND METHOD OF USE

(75) Inventor: David B. Gregory, Bay City, MI (US)

(73) Assignee: ReNew Systems, Inc., Bay City, MI (US)

( * ) Notice: Subject to any disclaimer, the term of this patent is extended or adjusted under 35 U.S.C. 154(b) by 0 days.

(21) Appl. No.: 10/994,562

(22) Filed: Nov. 22, 2004

(65) Prior Publication Data

US 2005/0109376 A1 May 26, 2005

Related U.S. Application Data

(60) Provisional application No. 60/523,554, filed on Nov. 20, 2003.

(51) Int. Cl.
*B08B 9/00* (2006.01)

(52) U.S. Cl. ..... 134/22.1; 134/22.18; 134/24; 134/26; 134/34; 134/36; 134/198; 134/19

(58) Field of Classification Search ..... 134/22.1, 134/22.18, 26, 24, 36, 19, 34, 198
See application file for complete search history.

(56) References Cited

U.S. PATENT DOCUMENTS 5,711,819 A * 1/1998 Miyasaki ..... 134/11
6,557,566 B1 * 5/2003 Rudolfs ..... 134/22.18
2003/0205247 A1 * 11/2003 Lengling et al. ..... 134/22.1

* cited by examiner

*Primary Examiner*—Zeinab El-Arini
(74) *Attorney, Agent, or Firm*—Reising, Ethington, Barnes, Kisselle, P.C.

(57) ABSTRACT

A method, system and apparatus for cleaning a tank through the use of a pair of spray heads arranged in operable communication with a pump via a pair of hose lines. One of the spray heads is operable to disperse a heated mist of cleaning solution, while the other spray head is operable to dispense a jet stream of the cleaning solution. The spray heads can be arranged in a closed loop, recirculating flow of the cleaning solution between the pump and the spray heads, or an open loop. Each hose line has a valve to control the flow of the cleaning solution therethrough so that the spray heads can operate independently from one another.

17 Claims, 7 Drawing Sheets

CLEANING SYSTEM AND METHOD OF USE

REFERENCE TO CO-PENDING APPLICATION

This application claims the benefit of U.S. Provisional Application No. 60/523,554, filed Nov. 20, 2003.

BACKGROUND OF THE INVENTION

1. Field of the Invention

This invention relates generally to cleaning apparatus, and more particularly to cleaning apparatus and their method of use for dispensing fluid under pressure onto a surface or surfaces being cleaned.

2. Related Art

Generally, large tanks, such as rail car tanks for example, or other vessels used in transporting liquids, accumulate a build-up of material on interior tank surfaces over time. This is particularly troublesome with solutions prone to build-up on surfaces in the form of solids, sludges, and slimes, such as occurs with latex, silicone, enamel, and the like. To avoid contamination, when the particular liquid is emptied from the tank, it is necessary to clean the tank prior to reusing the tank. Cleaning the tank typically involves one or more persons climbing into the tank and utilizing an extremely high pressure, i.e. 20,000–40,000 psi, power wash hose to remove the build-up from the tank surfaces. Generally, each person cleaning the tank is capable of cleaning a single surface at any given moment in time. Utilizing high pressure hoses to clean the tanks is not only time consuming, and thus, costly, but it can prove hazardous if the person comes in contact with the high pressure jet stream. In addition, the person within the tank must often take proper precautions to avoid exposure to potentially hazardous chemicals and dangers of working in a confined space.

SUMMARY OF THE INVENTION

A method of cleaning an inner surface of a tank such as a railroad car includes providing a supply of liquid cleaner solution and dispensing the liquid cleaner solution into the tank to create a pool of the liquid cleaner solution within the tank. Next, the method involves disposing a first spray head in the tank above the pool of liquid cleaner solution and in operable fluid communication with the cleaner solution and heating and dispersing the liquid cleaner solution under pressure in a fine liquid spray mist to cover the inner surface of the tank with a heated mist of the cleaner solution, the first spray head being in operable closed loop fluid communication with the pool of liquid cleaner solution. Next, after a suitable dwell period, the method involves dispensing the liquid cleaner solution from a second spray head provided in the tank above the pool of liquid cleaner solution and in operable fluid communication with the heated cleaner solution. The cleaner solution is dispensed from the second spray head in a controlled high pressure liquid jet stream to impinge the cleaner solutions on the previously treated inner surface of the tank, and then, rinsing the tank.

Another aspect of the invention provides a cleaning system for cleaning an inner surface of a tank. The cleaning system includes a fluid pump, a mount flange, and a first spray head, with a nozzle arranged to disperse liquid in a mist, carried by the mount flange and arranged for operable fluid communication with the fluid pump. A second spray head is carried by the mount flange for operable fluid communication with the fluid pump separately from the first spray head. The second spray head has a nozzle that is rotatable about an axis, with the nozzle being arranged to dispense liquid in a high pressure liquid stream from one or more directions. A heat source is in operable communication with said first spray head.

Another aspect of the invention provides a cleaning apparatus having a pair of spray heads operable to spray liquid independently from one another. The apparatus has a frame for carrying a motor and a pump, with the pump having an inlet and an outlet and being in operable communication with the motor. A pair of hose lines is arranged in fluid communication with the outlet of the pump. Each hose line has a valve to control the flow of fluid therethrough so that the hose lines can operate independently from one another. Each spray head is attached to a separate hose line, thereby enabling the spray heads to spray fluid independently from one another.

Some of the potential features and advantages included in at least some of the presently preferred embodiments of this invention, by way of example and without limitations, include an improved cleaning apparatus that is able to clean more than one surface at a time, provides mobility of the cleaning apparatus, enhances the usefulness of the cleaning apparatus, is capable of spraying different solutions at the same time, reduces the costs associated with cleaning surfaces of a tank, is of relatively simple design, is economical in manufacture and assembly, and reduces the harmful risks involved with cleaning the interior surfaces of enclosed chemical vessels.

BRIEF DESCRIPTION OF THE DRAWINGS

Some of the potential objects, features and advantages of the at least some of the presently preferred embodiments of this invention will become apparent from the following detailed description of the presently preferred embodiments and best mode, appended claims and accompanying drawings, in which:

DETAILED DESCRIPTION OF THE PREFERRED EMBODIMENTS

Referring in more detail to the drawings, FIGS. 1A–1E illustrate a cleaning system 10 according to one aspect of the invention. The cleaning system 10 is generally suitable for cleaning interior and/or exterior surfaces as desired, and is shown here, by way of example and without limitations, being used to clean an inner surface 12 of a rail car 14. It should be recognized that the cleaning system 10 can be used to clean an inner and/or outer surface of any tank, vessel, pipe, or the like. The cleaning system 10 allows the rail car 14 to be cleaned in the absence of a person being present in the tank, thereby eliminating potential sources of hazard to a person, such as being exposed to an extremely high pressure jet stream of liquid, i.e. 20,000-40,000 psi, or being exposed to toxic chemicals. In addition, the cleaning system 10 greatly reduces the amount of water consumed during the cleaning process, thus, reducing the associated costs for cleaning the rail car 14.

Figure 1A:
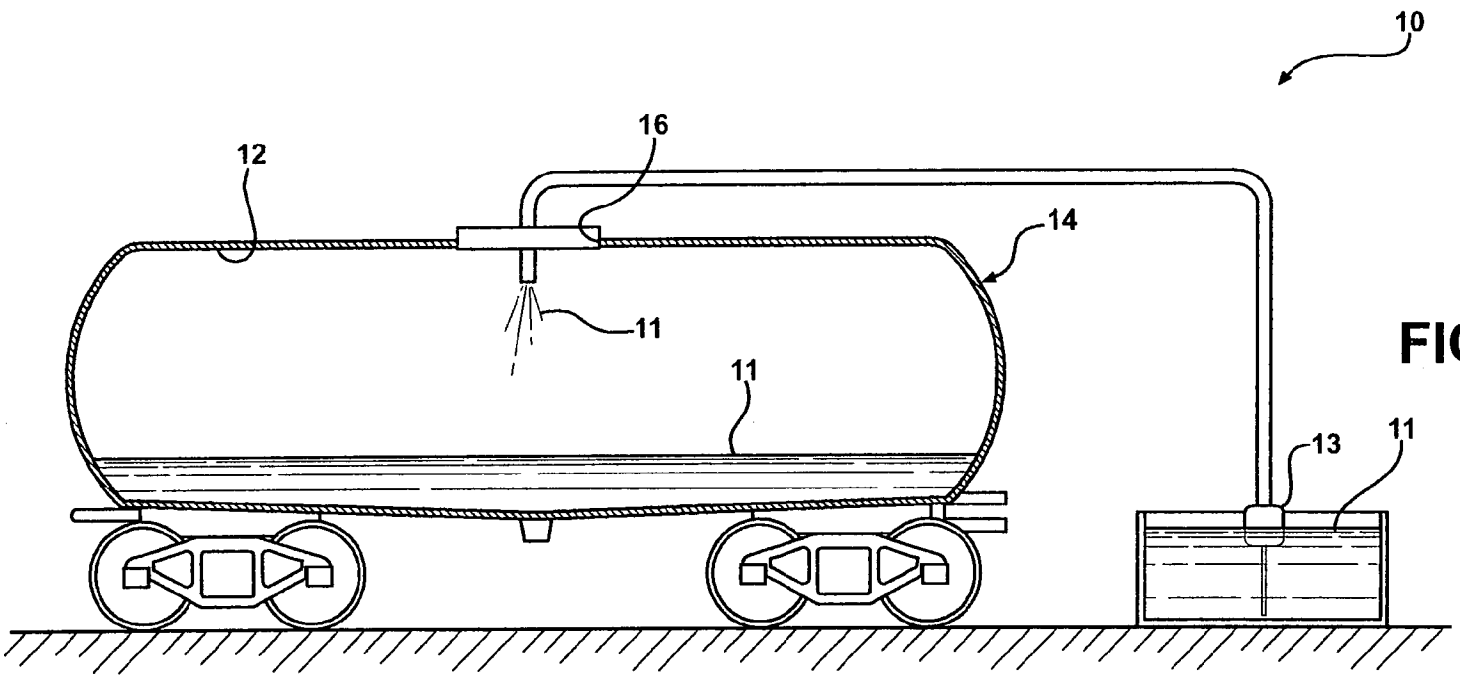
FIGS. 1A–1E are schematic diagrams representing a cleaning system according to one presently preferred embodiment of the invention.

In FIG. 1A, the rail car 14 is shown having an enzymatic cleaner solution 11 dispensed therein. The cleaner solution 11 is preferably purchased from ReNew Systems, Inc., of Bay City, Mich., and is preferably referenced under the product designation Silzyme™ cleaner. The environmentally non-toxic enzymatic solution 11 is generally produced as a base solvent mixture having no anti-bacterial activity and including a surfactant-penetrant-releasing agent (A) and an enzyme component solution (AB), such as can be purchased from Renew Systems, Inc., of Bay City, Mich., under the product designation Silzyme™, referred to hereafter as (B). The liquid mixture (A) may include N-Methyl-2-Pyrrolidone as a surfactant-solvent (2.3–2.4%), ethoxylated octyl phenol as a binder-thickener (2.2–2.3%) and texanol (1.5–1.6%) as a penetrant with the balance typically water. The enzymatic solution (B) may contain one or more enzymes such as lipase, alpha-amylase, protease (1.8–1.9%), or the like, or a mix thereof in an enzyme protectant stabilizer solution including propylene glycol (1.8–1.9%), or the like. The mixture of (A) and (B) is generally in the volume/ratio of at least 90 parts (A) to 10 parts (B) or alternatively 10 parts (A) to 1 part (B), with the percentage indicated by volume. The resulting mixture is blended for about two hours, and thereafter, turbidity and pH measurements are taken. The term enzyme is intended herein to include the well known complex proteins produced by the living cells of high molecular weights and consisting of multiple amino acids combined in a characteristic sterically oriented structure and newer and genetically engineered enzyme compositions. A variety of basic enzyme types may include hyrdolases, isomerases, ligases, lyases, oxidoreductases, and transferases. More specifically, the enzyme may come from the fermentation of a strain of Baccilus licheniformis. The percentage of enzymes by volume used in part (B) may be in the range 0.5–3% by volume.

Upon measuring the pH of the mixture (AB), it is determined how much of a base solution, such as sodium borate ($NaBO_4$) mixed in water, designated hereafter as (C), needs to be added to the mixture (AB) to bring the mixture up to a pH neutral range, defined as being between 6–8 on the pH scale. Upon adding the determined amount of the base solution (C) to the mixture (AB), the pH is measured again (see FIG. 3). If the pH is within the designated pH neutral range, then the resulting mixture (AB) and (C), hereafter referred to as (ABC), is ready for use. However, if the mixture (ABC) is not within the pH neutral range, more base solution (C) may be added to raise the pH level, or an acidic solution, such as citric acid or hydrochloric acid solution, for example, can be added to the mixture (ABC) to reduce the pH. The Silzyme™ solution is preferably diluted with water to provide about a 20 percent concentration of Silzyme™ cleaner to water. It should be recognized that other cleaner solutions may be used with the cleaning system 10, such as, by way of example and without limitations, Acqueous Reactivator™, Xzyme™, and Decontaminator™, all available from ReNew Systems, Inc. Preferably, about 500 to 1500 gallons of the cleaner solution 11 are dispensed into the rail car 14, when the rail car 14 generally has a 22,000 gallon tank capacity. It should be recognized that any suitable pump 13 may be used to dispense the cleaner solution 11 through an opening 16 in the rail car 14.

Figure 1B:
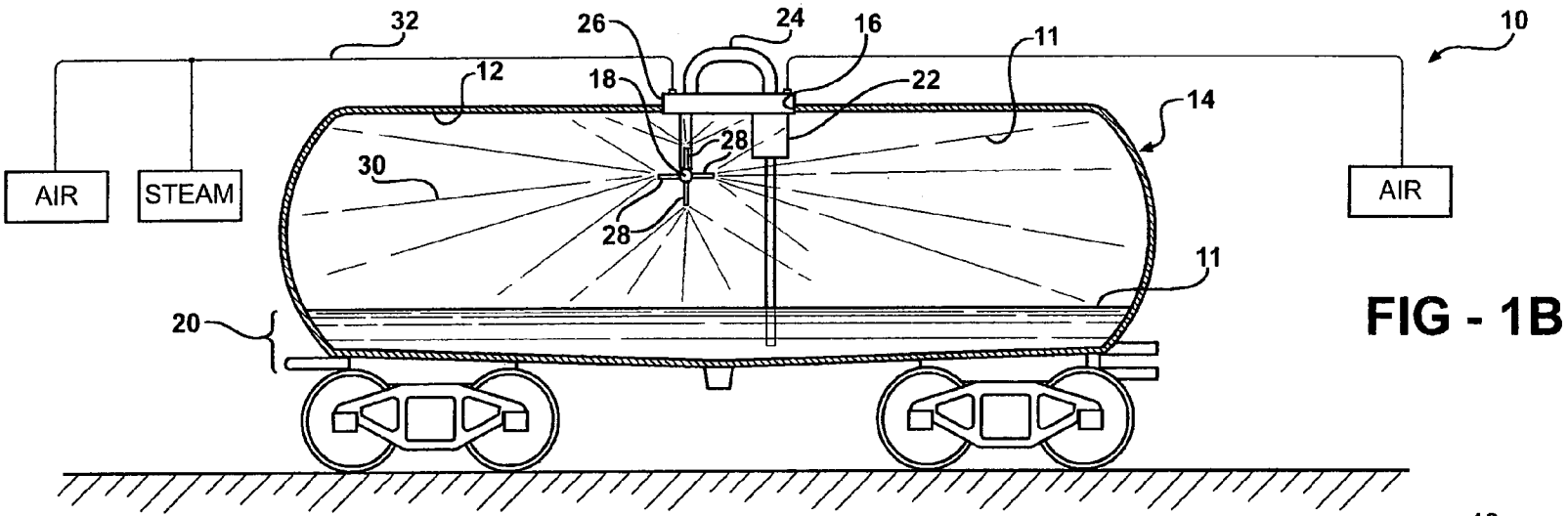
Figure 1C:
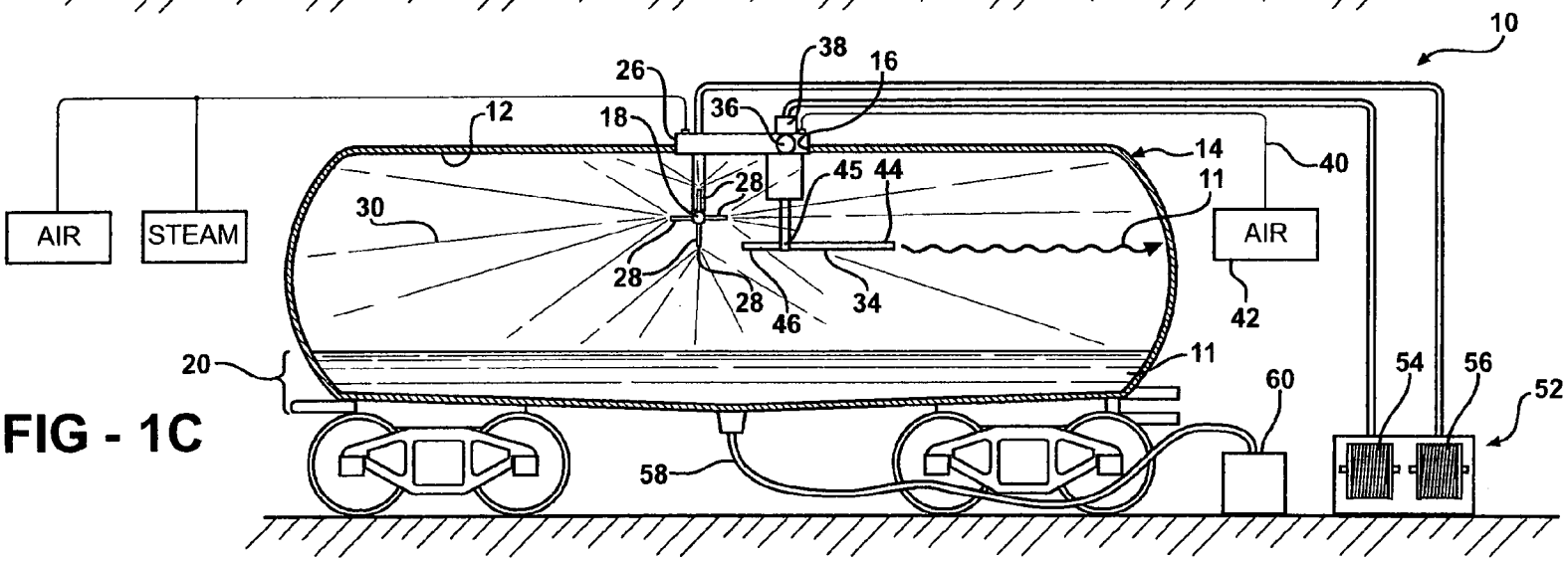

As shown in FIG. 1B, upon dispensing the desired amount of cleaner solution 11 into the rail car 14, a first spray head, referred to hereafter as a misting head 18, is disposed within the rail car 14 to disperse a fine mist of the cleaner solution within the rail car in a soaking or misting procedure and to create a pool of the cleaner solution 11 within the tank as shown in FIGS. 1B and 1C. As is also shown in FIGS. 1B and 1C. the misting head 18 is disposed above the pool of cleaner solution 11. One presently preferred embodiment of the misting head 18 is readily available from Auto Jet Technologies, a division of Spraying Systems Company of Wheaton, Ill., U.S.A., under model number 8050. The misting head 18 is in operable fluid communication with the pool of cleaner solution 11 in a bottom portion 20 of the rail car 14, and more preferably a sump pump 22 is used to pump the cleaning fluid from the pool of cleaner solution 11 through a fluid line 24 to the misting head 18 in a recirculatory fashion to issue fine droplets on the order of microns or less in diameter. To facilitate creating a closed:loop environment, preferably the misting head 18 and the sump pump 22 are attached to a flange mount or lid 26 and depend therefrom into the rail car 14. The lid 26 is preferably sized to create a liquid tight seal with the opening 16 in the rail car 14. The recirculatory. closed-loop flow of the cleaning fluid is best shown in FIGS. 1B, 1C, and schematically in FIGS. 6. and 7.

The misting head 18 preferably has a plurality of spray nozzles 28 for dispensing the cleaner solution 11 in spray mist 30 over a 360 degree circular spray pattern. The fog like atmosphere created by the fine spray mist 30 of cleaner solution 11 causes the inner surface 12 of the tank above the pool of cleaner solution 11 to be completely covered with the cleaner solution 11 as shown in FIGS. 1B and 1C. Depending on the severity of the cleaning required, the recirculatory misting procedure preferably continues in a soaking step between about 6–10 hours, as needed. Some dwell time before other processing may also be incorporated in the soaking step so long as the temperature at the interior surface is substantially maintained. It should be recognized that the misting procedure does not require the continued presence of a person, and that it can be left under automated controls, including timers for turning on and off the pump 22, and the like.

To facilitate the cleaning efficacy, preferably a heat source and atomizer, such as, by way of example and without limitations, a steam line or combination air/steam line 32, is connected to the misting head 18 to communicate steam and/or air under pressure with the cleaner solution 11 to heat and atomize the cleaner solution as it is being dispensed from the spray nozzles 28. Preferably, when cleaning a latex or similar composition, the cleaner solution 11 is heated to a temperature between about 145–160 degrees Fahrenheit (F.) to ultimately bring the temperature of the fog inside the rail car 14 to a temperature between about 145 and 160 degrees (F.). Upon the cleaner solution and the tank interior wall surface reaching the upper temperature limit of 160 (F), with the fog filling the tank, the steam can be shut off, and thereafter the pressure of the air alone can be used to disperse the recirculating heated cleaner solution from the misting head 18. It should be recognized the heating temperature may be other than as described above, for example, if cleaning a silicone or foods, by way of example and without limitations, the temperature could be lower, such as about 120 degrees (F.).

Upon completion of the misting procedure described above, as shown in FIG. 1C, a second spray head, referred to hereafter as a jet stream head 34, is supported above the pool of liquid cleaner solution 11 and is used to dispense the cleaner solution 11 in a high pressure stream to impinge the inner surface 12 of the rail car 14 in a washing or blasting procedure. The cleaner solution in this embodiment is withdrawn via drain line 58 and furnished to the jet head 34 in a manner which presently will be described in detail. Depending on the severity of cleaning required, the washing procedure is generally performed between about 4–16 hours. The misting head 18 can still be used in conjunction with the jet stream head 34, as shown in FIG. 1C, if desired. Preferably, the jet stream head 34 is in operable fluid communication with the pool of cleaner solution 11 in the rail car 14 in a recirculatory mode, as shown in FIG 1C, though the jet stream head 34 could be arranged for fluid communication with a different source of cleaner solution external to the rail car 14, if the particulate material being removed required it. The jet stream head may also be obtained from the Auto Jet Technologies division previously mentioned. To facilitate creating a liquid tight sealed environment, preferably the jet stream head 34 is attached to the lid 26 and depends therefrom a predetermined distance into the rail car 14. Preferably, the jet stream head 34 is pivotal via a liquid tight ball joint 36 so it can be oriented as desired within the rail car 14. Additionally, a liquid tight compression sleeve 38 is preferably used to allow the jet stream head 34 to be raised and lowered within the rail car 14, as necessary to position the jet stream head 34 to the desired height within the rail car 14.

The jet stream head 34 is operably connected to an air line 40 (FIG. 7), wherein the air line 40 channels pressurized air provided by an air motor or compressor 42, with an air pressure resulting generally between 5–20 psi. The pressurized air causes a spray nozzle or nozzles 44 of the jet stream head 34 to rotate so that the entire inner surface 12 of the rail car 14 is impinged by the high pressure stream over a time of about 10–45 minutes. To facilitate a balanced 360 degree rotation of the spray nozzle 44, preferably a counterweight 46 or second spray nozzle is attached to the jet stream head 34 opposite the spray nozzle 44 so the spray nozzle 44 or nozzles rotate about a centroid 45 of the jet stream head 34.

Figure 5:
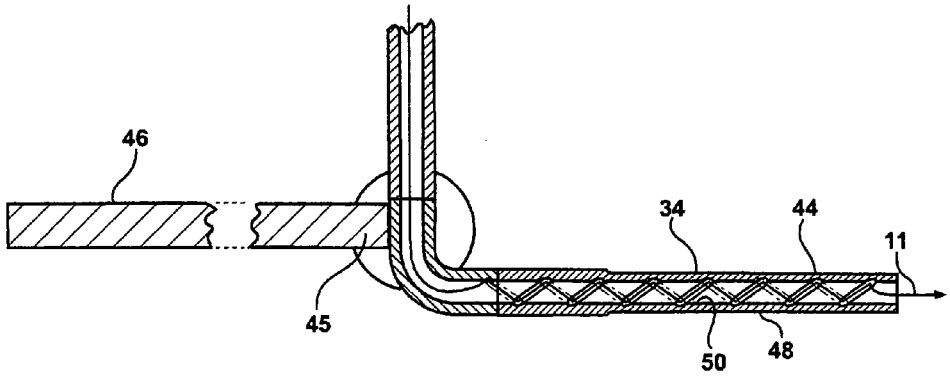
FIG. 5 is a partial cross-sectional view of one spray nozzle assembly according to one presently preferred embodiment of the invention.

As shown in FIG. 5, to facilitate creating the high pressure stream, the spray nozzle 44 has a barrel 48 with a rifled or helical inner groove 50. The helical groove 50 preferably makes a complete 360 degree turn between about 4–9 times per foot, such that the cleaner solution 11 dispensed under pressure though the spray nozzle 44 takes on a vortical stream pattern to facilitate maintaining a relatively high momentum upon impacting the inner surface 12 of the rail car 14. The jet stream head 34 is generally capable of dispensing the cleaner solution 11 radially outwardly about 40 feet with considerable force, thereby rendering the jet stream head 34 capable of cleaning a tank having an inner span or diameter of about 80 feet. The jet stream is dispensed under a pressure generally between 500–2000 psi, while consuming generally between 3–45 gpm of solution from the source of fluid supply, whether it be from the rail car 14 being cleaned in a recirculation mode of operation from supply 11, or from a separate container external to the rail car 14. It should be recognized that depending on the nature of the cleaning being performed, that other types and models of spray nozzle assemblies may be used in place of the misting head 18 and the jet stream head 34, as desired.

Figure 2:
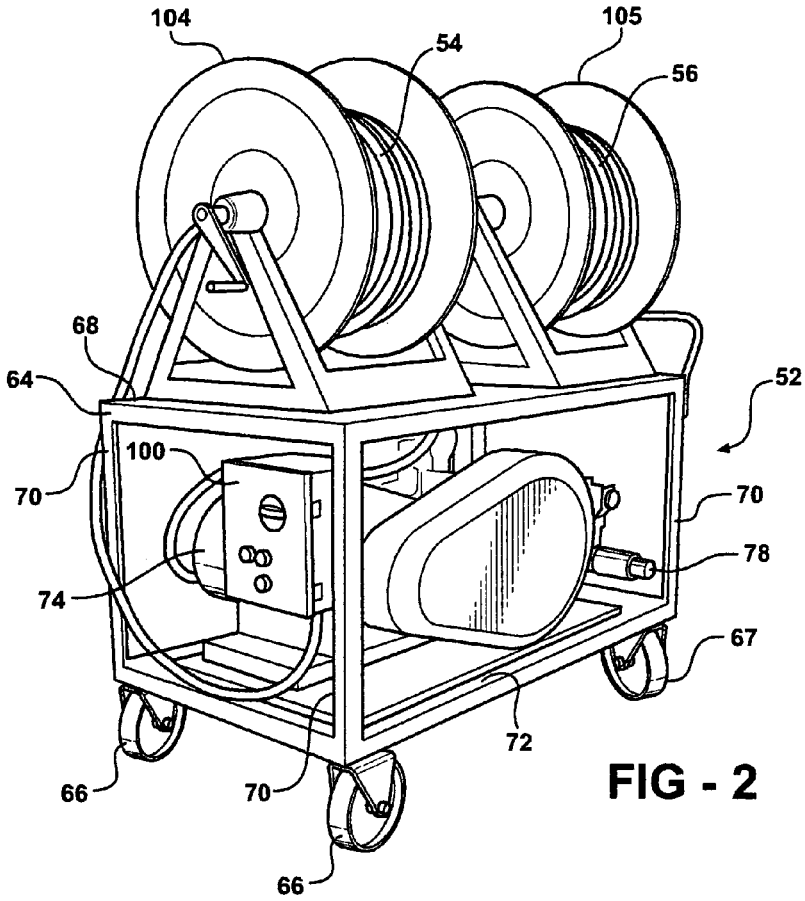
FIG. 2 is a front perspective view of a pump apparatus according to one embodiment of the invention.
Figure 3:
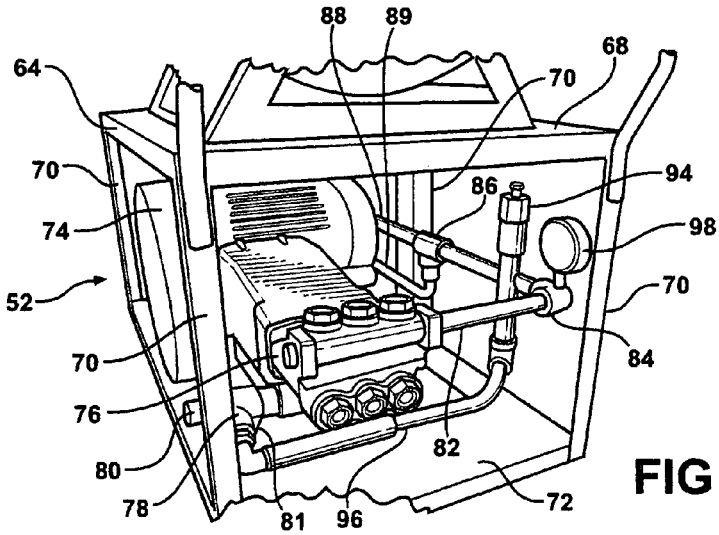
FIG. 3 is a rear perspective view of the apparatus of FIG. 2.
Figure 4:
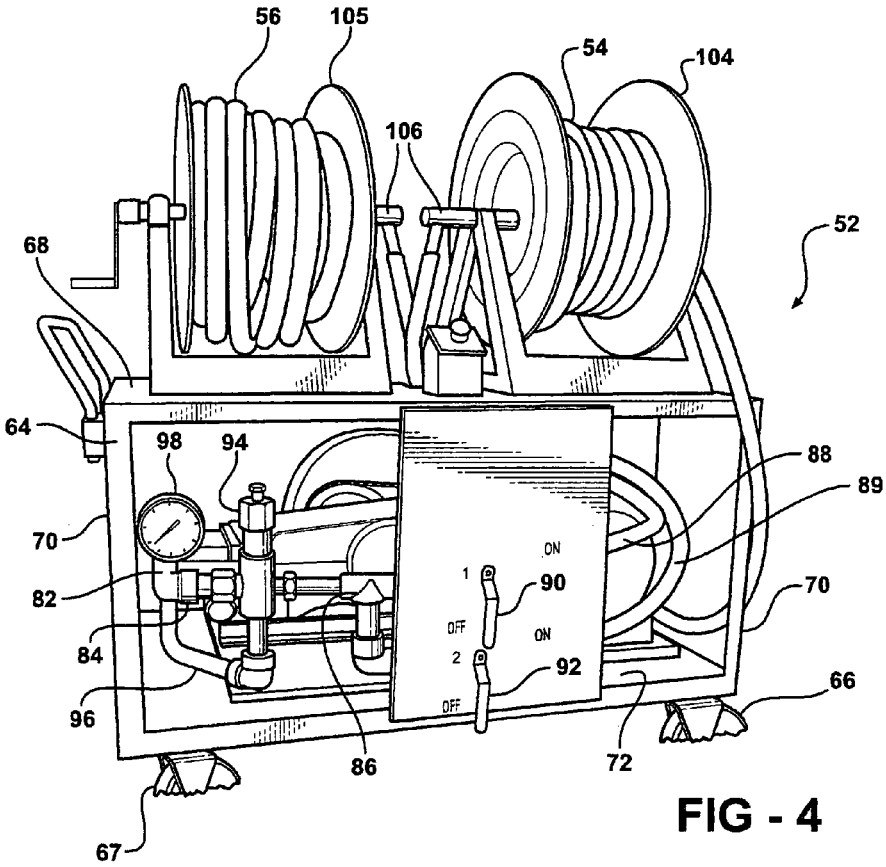
FIG. 4 is a side view of the apparatus of FIG. 2.

The jet stream head 34 is attached preferably in a closed loop to a pump assembly represented generally at 52 in FIGS. 2–4. The pump assembly 52 has at least one, and shown here as a pair, of hoses 54, 56, with one of the hoses 54 being arranged for fluid communication with the misting head 18, and the other of the hoses 56 being arranged for fluid communication with the jet stream head 34. As such, the pair of hose lines 54, 56 facilitates cleaning at least one or more surfaces with the same cleaning system 10 at the same time.

The return hose 58 is preferably connected to a lower most portion of the rail car 14 so the cleaner solution 11 can be routed with the assistance of gravity to the pump assembly 52. Preferably, a filter 60 capable of filtering out sediment greater in size than about 5–10 microns is incorporated in line with the return line 58 to remove any sediment from the cleaner solution prior to its returning to the pump assembly 52. By way of example, and without limitations, the filter 60 could be provided in a 55 gallon drum and be constructed to be an intentional "weak link" in the system. Accordingly, if the pump assembly 52 is being starved of fluid, or if some other problem arises in the flow of fluid throughout the cleaning system 10, the drum can be designed to collapse and shut down the system 10, thereby minimizing or eliminating any damage to other components within the system 10.

Figure 1D:
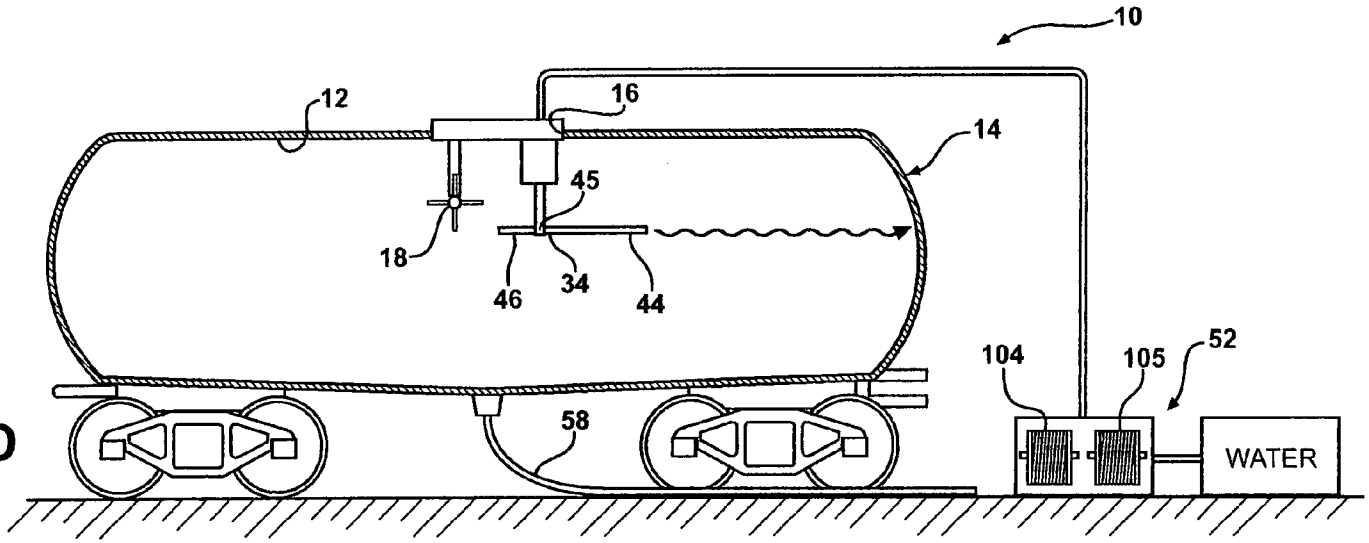

Upon completion of the washing procedure, as shown in FIG. 1D, a rinsing procedure is preferably performed by directing water or some other mild rinse solution via the pump assembly 52 to the jet spray head 34. The water from the jet spray head 34 impinges the inner surface 12 of the rail car 14, as described above, and the resulting flow of water is preferably routed via the return hose 58 to a drain or collection area. It should be recognized that rather than using gravitational assistance to allow the cleaner solution and water to flow from the rail car 14 via the return hose 58, a pump (not shown) could be used in combination with gravity, or solely, if the tank being cleaned is below ground, or otherwise in a position rendering gravitational assistance impossible.

Figure 1E:
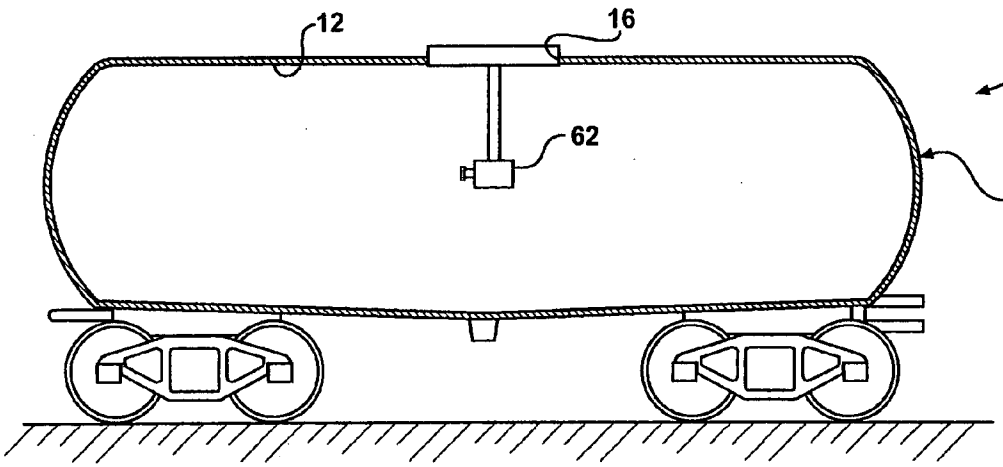

Upon completing the rinsing procedure, as shown in FIG. 1E, the rail car 14 is preferably inspected, such as with a camera 62 disposed within the rail car 14 along with suitable lighting, or by a person. If the inspection shows any residue, a standard power hose can be used to spot clean the inner surface 12 of the rail car 14.

The pump assembly 52, as shown in FIGS. 2-4 constructed according to one aspect of the invention, has a frame 64 supported on a pair of front and rear casters 66, 67 to facilitate moving the pump assembly 52 from one location to another to increase its usefulness. The casters 66, 67 are lockable to prevent movement of the pump assembly 52 while in use, and otherwise unlockable to allow the pump assembly 52 to be transported on the casters 66, 67. Desirably, at least one pair of casters 67 is pivotal to facilitate turning the pump assembly 10.

The frame 64 has a top surface 68 supported by a plurality of upright supports 70 extending upwardly from a base 72 and defining a space between the base 72 and the top surface 68. Within the space, as best shown in FIG. 3, a motor 74 and a pump 76 are carried in operable communication with one another on the base 72. The motor 74 is represented here, for example and without limitations, as a General Electric Model No. S245, having the following specifications: 15 hp, 230/460 VAC 3 phase, 60 hz, and a 254 T frame. The pump 76 is represented, for example and without limitations, as a Cat Triplex plunger, with a 316 stainless steel manifold. The pump 76 can deliver 800 psi at 27 gallons per minute (gpm), and has a 42 amp current draw. The pump 76 requires 4 inches of head minimum, and generally requires 35 gpm of fluid to be available. It should be recognized that other motors and pumps may be used, such as, by way of example and without limitations, a 25 hp motor and a pump delivering 150 psi at 78 gpm, for example.

Figure 6:
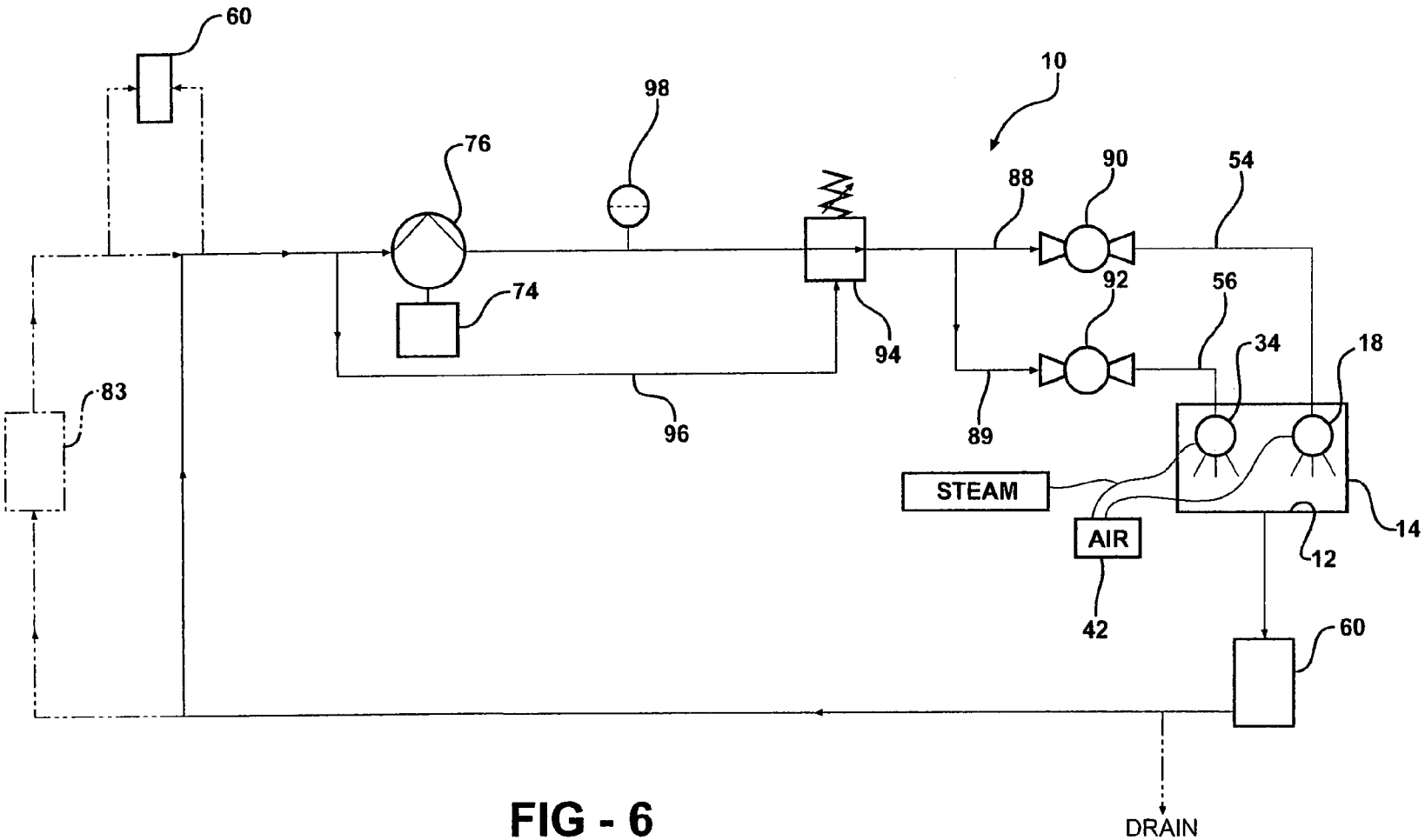
FIG. 6 is a schematic control diagram for one embodiment of the cleaning apparatus system of the invention.
Figure 7:
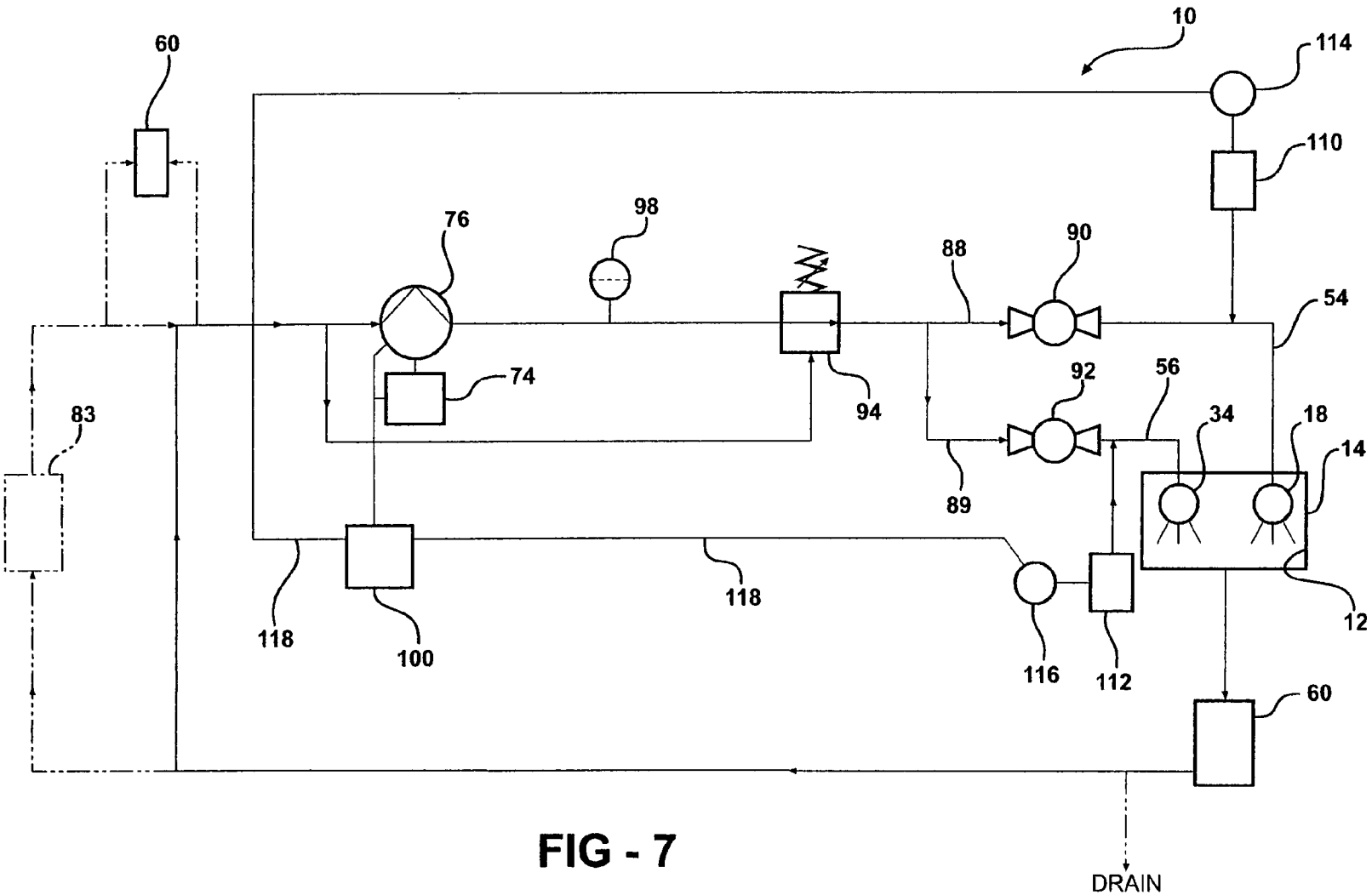
FIG. 7 is another schematic control diagram showing another embodiment.

The pump 76 has an inlet connector 78 (FIGS. 2 and 3) with a pair of inlet openings 80, 81, with one of the openings 80 being arranged for connection to a supply hose, such as the return hose 58, providing fluid communication in a recirculation mode with the fluid in the rail car tank 14 being cleaned (FIGS. 1A–1E, 6 and 7), or with a separate container of solution 83, for example, cleaner solutions available from ReNew Systems, Inc., for directing the solution into the pump 76 and through an outlet 82 (FIGS. 3, 6 and 7) of the pump 76. As shown in FIGS. 3 and 4, an outlet fluid line or conduit 84 extends from the outlet 82 to a bifurcated junction 86 where the conduit 84 diverges into two separate output conduits 88, 89. As shown in FIGS. 4, 6 and 7, each separate conduit 88, 89 has a manually or electrically operated valve, represented here, for example, as ball valves 90, 92 for operably turning the flow of fluid through the separate output conduits 88, 89 on or off, as desired.

To prevent unwanted pressure buildup in the outlet conduit 84, a pressure regulating valve 94 is preferably inserted between the junction 86 and the outlet 82 of the pump 76. The pressure regulating valve 94 is in fluid communication with a bypass conduit 96, wherein the bypass conduit 96 redirects fluid back to the inlet opening 81 of the inlet connector 78. Preferably, to provide an operator with a precise pressure reading, a pressure gauge 98 is attached to the outlet conduit 84 between the pressure regulating valve 94 and the outlet 82 of the pump 76. It should be recognized that the pressure regulating valve 94 is preferably adjustable to regulate the pressure through the valve 94. Accordingly, an operator can adjust the amount of fluid pressure traveling to the pair of output conduits 88, 89 downstream of the pressure regulating valve 94.

Referring again to FIG. 2, a control module 100 is preferably carried by the frame 64, such as by being attached to one or more of the upright supports 70. The control module 100 preferably has a power cord with a plug adaptor constructed for attachment to a standard 220V power supply. The control module 100 is in electrical communication via a wire harness with the motor 74 and the pump 76. Preferably, the control module 100 allows an operator to adjust the speed of the motor 74, and thus, the gpm of fluid output of the pump 76.

As shown in FIGS. 2 and 4, a pair of hose reels 104, 105 is rotatably carried by the frame 64, such as by being supported on the top surface 68 of the frame 64. Each hose reel 104, 105 has a separate one of the hose lines 54, 56 coiled about a separate hollowed axle (FIG. 3) with an end (not shown) of each hose line 54, 56 attached in fluid communication with a separated one of the hollowed axles. Each axle is preferably supported by a pair of bearing blocks. Each of the pair of output conduits 88, 89 is attached in fluid communication with a separate one of the hose lines 54, 56 via the hollowed axles at a separate inlet port 106 in each of the separate axles. Accordingly, with the valves 90, 92 in their open or on position, fluid is free to flow through the output conduits 88, 89, through the hollowed axles, and through the separate hose lines 54, 56. Accordingly, it should be recognized that one or both of the hose lines 54, 56 may be utilized, depending on whether one or both of the valves 90, 92 is in the on or off position, as desired.

In FIG. 6, a schematic diagram shows the cleaning system 10 utilizing both of the hose lines 54, 56 for dispensing the cleaner solution 11 from the misting head 18 and jet stream head 34. As mentioned above, depending on the application of the cleaning system 10, any suitable spray nozzle may be attached to the ends of the hose lines 54, 56. Accordingly, while an operator attaches one of the misting head 18 or jet stream head 34 to one hose line 54 to clean the inner surface 12 of the tank 14, a separate spray nozzle (not shown) may be attached to the other hose line 56 to spray an external surface of the tank 14, or some other surface, as desired. This is particularly useful when cleaning tanker truck vessels, rail car vessels, pharmaceutical tanks, food processing tanks, paint blenders, and other large storage tanks, for example.

Another embodiment of a cleaning apparatus 10 is shown schematically in FIG. 7, wherein at least one, and shown here as a pair, of chemical solution tanks 110, 112 are attached for fluid communication between the pair of ball valves 90, 92 and the spray heads 18, 34. The chemical solution tanks 110, 112 can be equipped with separate pumps 114, 116 for controlling the disbursement of the chemical solution within the tanks 110, 112 into a separate one of the hoses 54, 56. In addition, the pumps 114, 116 for the cleaner solution tanks 110, 112 may be operably controlled or programmed at the control module 100 through electrical connections or wires 118 between the control module 100 and the pumps 114, 116. Accordingly, each chemical solution tank 110, 112 may have a different chemical solution therein, thereby providing the operator with the ability to dispense different chemical solutions with different mixture concentrations from each head 18, 34, depending on the type of cleaning being performed.

It should be recognized that the embodiments discussed above are exemplary embodiments, and thus, are intended to be illustrative and not limiting. The scope of the invention is defined by the following claims.

What is claimed is:

1. A method of cleaning an inner surface of a tank, comprising the steps of:

a. providing a supply of liquid cleaner solution;

b. dispensing said liquid cleaner solution into the tank to create a pool of said liquid cleaner solution within the tank;

c. providing a first spray head for dispensing said liquid cleaner solution under pressure in a fine mist;

d. disposing said first spray head in the tank above the pool of liquid cleaner solution and in operable closed loop fluid communication with said pool of liquid cleaner solution;

e. heating said liquid cleaner solution;

f. dispersing said liquid cleaner solution under pressure through said first spray head in a heated fine liquid spray mist and covering the inner surface of the tank above the pool of said liquid cleaner solution with a said heated fine liquid spray mist of said liquid cleaner solution;

g. providing a second spray head for dispensing said liquid cleaner solution in a controlled high pressure liquid jet stream;

h. disposing said second spray head in the tank above the pool of said liquid cleaner solution and in operable fluid communication with said pool of liquid cleaner solution;

i. dispensing said liquid cleaner solution from said second spray head after the step of dispersing said liquid cleaner solution through said first spray head, to impinge the inner surface of the tank with a controlled high pressure jet stream of said liquid cleaner solution; and j. rinsing said liquid cleaner solution from said tank.

2. The method of claim 1 further including maintaining said liquid cleaner solution within the tank between about 120 and 160 degrees Fahrenheit during the step of dispersing said liquid cleaner solution through said first spray head.

3. The method of claim 1 further including removing said liquid cleaner solution from the tank and filtering said liquid cleaner solution and recirculating said filtered liquid cleaner solution to said tank through said second spray head during the step of dispensing said liquid cleaner solution from said second spray head.

4. The method of claim 1 further including dispensing said liquid cleaner solution from said second spray head in a vortical stream.

5. The method of claim 1 further including rotating said second spray head about its centroid during the step of dispensing said liquid cleaner solution from said second spray head.

6. The method of claim 1 including performing the step of dispersing said liquid cleaner solution through said first spray head, prior to the step of dispensing said liquid cleaner solution from said second spray head, and again during the step of dispensing said liquid cleaner solution from said second spray head.

7. The method of claim 1 including providing said liquid cleaner solution as an enzymatic solution.

8. The method of claim 1 further including connecting a pump in closed loop fluid communication with said first spray head and the pool of liquid cleaner solution to dispense said liquid cleaner solution from the pool of liquid cleaner solution to said first spray head during the step of dispersing said liquid cleaner solution through said first spray head.

9. The method of claim 1 further including providing a source of steam to said first spray head to perform the heating step.

10. A method of cleaning an inner surface of a rail car tank having a volume of about 22,000 gallons, the rail car tank having an upper surface with an opening and a lid to open and close the opening, comprising the steps of:

a. providing a supply of about 500–1500 gallons of liquid cleaner solution;

b. dispensing said supply of liquid cleaner solution into the rail car tank to create a pool of said liquid cleaner solution within the rail car tank;

c. providing a first spray head for dispensing said liquid cleaner solution in a fine liquid spray mist;

d. attaching said first spray head to said lid so that said first spray head depends from said lid into the tank above the pool of liquid cleaner solution, said first spray head being adapted for operable fluid communication with said pool of liquid cleaner solution;

e. heating said liquid cleaner solution;

f. dispersing said liquid cleaner solution under pressure through said first spray head to cover the inner surface of the rail car tank with a heated fine liquid spray mist of said liquid cleaner solution;

g. providing a second spray head for dispensing said liquid cleaner solution in a controlled high pressure liquid jet stream;

h. attaching said second spray head to said lid so that said second spray head depends from said lid into the tank above the pool of liquid cleaner solution, said second spray head being adapted for operable fluid communication with said pool of liquid cleaner solution;

i. dispensing said liquid cleaner solution from said second spray head after the step of dispersing said liquid cleaner solution through said first spray head, to impinge the inner surface of the rail car tank with a controlled high pressure jet stream of said liquid cleaner solution; and j. rinsing said liquid cleaner solution from said tank.

11. The method of claim 10 further including attaching a pump in closed loop fluid communication with said first spray head and submerging said pump in the pool of liquid cleaner solution to recirculate said liquid cleaner solution from the pool of liquid cleaner solution through said first spray head during the step of dispersing said liquid cleaner solution through said first spray head.

12. The method of claim 10 including providing said liquid cleaner solution as an enzymatic solution.

13. The method of claim 10 including performing the step of dispersing said liquid cleaner solution through said first spray head, prior to the step of dispensing said liquid cleaner solution from said second spray head, and again during the step of dispensing said liquid cleaner solution from said second spray head.

14. The method of claim 10 further including removing said liquid cleaner solution from the tank and filtering said liquid cleaner solution and recirculating said filtered liquid cleaner solution to said tank through said second spray head during the step of dispensing said liquid cleaner solution from said second spray head.

15. A method of cleaning an inner surface of a rail car tank having a volume of about 22,000 gallons, the rail car tank having an upper surface with an opening and a lid to open and close the opening, comprising the steps of:

a. providing a supply of about 500–1500 gallons of liquid cleaner solution;

b. providing a first spray head for dispensing said liquid cleaner solution in a fine liquid spray mist;

c. attaching said first spray head to said lid so that said first spray head depends from said lid into the tank, said first spray head being adapted for operable fluid communication with said liquid cleaner solution;

d. heating said liquid cleaner solution;

e. dispersing said liquid cleaner solution under pressure through said first spray head to cover the inner surface of the rail car tank with a heated fine liquid spray mist of said liquid cleaner solution;

f. providing a second spray head for dispensing said liquid cleaner solution in a controlled high pressure liquid jet stream;

g. attaching said second spray head to said lid so that said second spray head depends from said lid into the tank, said second spray head being adapted for operable fluid communication with said liquid cleaner solution;

h. dispensing said liquid cleaner solution from said second spray head after step (e) to impinge the inner surface of the rail car tank with a controlled high pressure jet stream of said liquid cleaner solution; and i. rinsing said liquid cleaner solution from said tank.

16. The method of claim 15 including performing step e prior to the step of dispensing said liquid cleaner solution from said second spray head and again during the step of dispensing said liquid cleaner solution from said second spray head.

17. The method of claim 15 including providing said liquid cleaner solution as an enzymatic solution.

* * * * *